United States Patent [19]

Beck et al.

[11] 4,085,687

[45] Apr. 25, 1978

[54] REMOTE ENVELOPE DEPOSITORY CONSTRUCTION

[75] Inventors: Robert Beck; Herbert J. Morello, both of North Canton; Jack M. Richardson, Canton, all of Ohio

[73] Assignee: Diebold, Incorporated, Canton, Ohio

[21] Appl. No.: 648,281

[22] Filed: Jan. 12, 1976

[51] Int. Cl.[2] ..... G07G 5/00

[52] U.S. Cl. ..... 109/24.1; 346/22

[58] Field of Search ..... 109/24.1, 66; 232/44; 346/22

[56] References Cited

U.S. PATENT DOCUMENTS

| | | | |
|---|---|---|---|
| 3,078,789 | 2/1963 | McGee | 109/24.1 |
| 3,079,603 | 2/1963 | Simjian | 346/22 |
| 3,295,139 | 12/1966 | Simjian | 346/22 |
| 3,836,980 | 9/1974 | Grosswiller et al. | 346/22 |

*Primary Examiner*—Robert L. Wolfe
*Assistant Examiner*—David H. Corbin
*Attorney, Agent, or Firm*—Frease & Bishop

[57] ABSTRACT

A depository construction for receiving deposits at unattended banking equipment units in deposit-containing envelopes, and for issuing receipts for such deposits to bank customers. The customer activates the depository mechanism to initiate a deposit procedure by pressing a button, using a key or inserting a customer-identifying card at a banking unit. Activation of the mechanism opens an entry gate for a horizontal deposit entry slot to permit a deposit-containing envelope to be inserted into the slot, and energizes the drive mechanism of an envelope belt conveyor to transport the envelope through the mechanism. As the trailing end of the envelope passes an entry sensor, the entry gate is closed and a conveyor exit gate is opened. As the leading end of the envelope arrives at the exit end of the conveyor, an exit sensor energizes a printer beyond the exit end of the conveyor which stamps deposit data on the envelope. Another printer prints similar data on a receipt while the envelope is being discharged from the conveyor. As the trailing end of the envelope passes the exit sensor and drops to a deposit chest, the conveyor drive is stopped and the receipt is issued to the customer.

6 Claims, 17 Drawing Figures

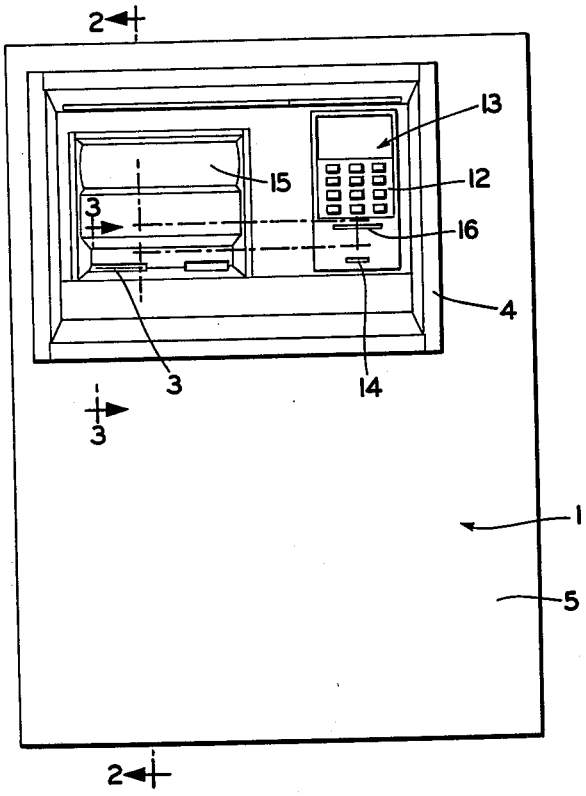
FIG.1
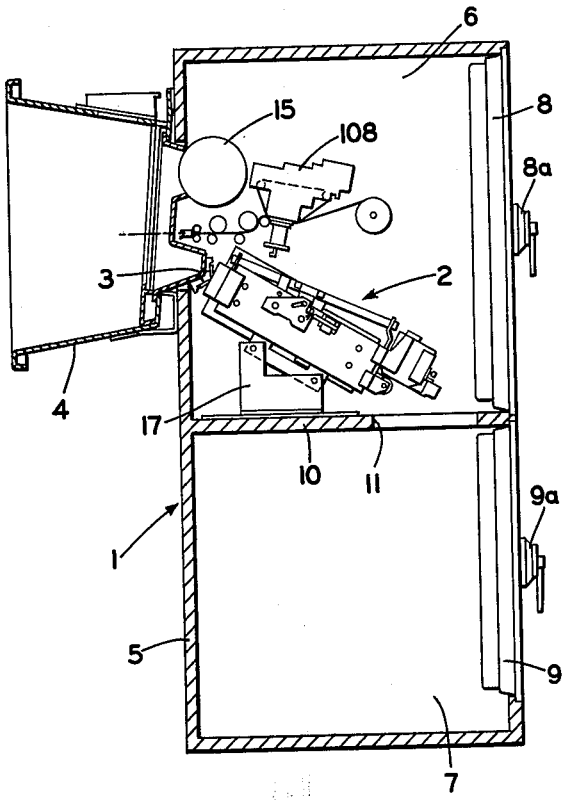
FIG.2
FIG.3
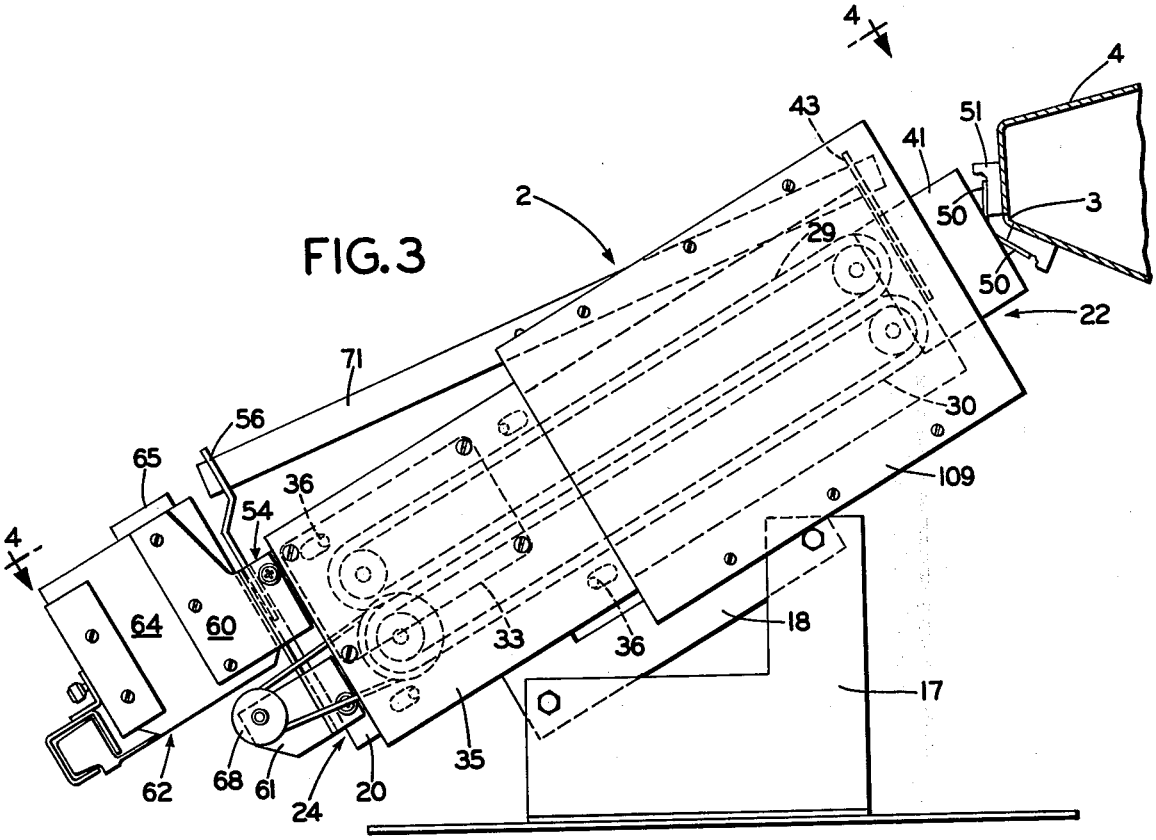

LS101

REMOTE ENVELOPE DEPOSITORY CONSTRUCTION

CROSS REFERENCE TO RELATED PATENTS

The remote depository construction constitutes improvements on the constructions shown in U.S. Pat. Nos. 3,028,074, 3,836,980 and 3,897,901.

BACKGROUND OF THE INVENTION

1. Field of the Invention

The invention relates to equipment for accepting bank deposits from a customer at unmanned stations remote from a bank's central office. It accepts deposits automatically from authorized persons. The depository equipment desirably may be combined with automatic currency dispensing equipment so that various banking services may be conducted at such remote unmanned stations continuously, day in and day out, twenty-four hours a day.

The depository equipment issues a receipt to the customer-depositor after the deposited material has been discharged to a deposit chest. Operation of the depository equipment may be coordinated with or actuated by devices also used in controlling currency dispensing operations at the remote station.

2. Description of the Prior Art

Many different types of bank depository mechanisms at unmanned stations are known in the prior art, both hand and power driven, and straight line and rotary in design. Depository devices which accept only deposit-containing envelopes have used straight line conveyors, either hand or power driven; and frequently belt-type conveyors are used, such as shown for example in U.S. Pat. Nos. 2,963,333, 3,028,074, 3,078,789, and 3,836,980.

Envelope depository devices also have been used as components of automatic banking equipment which are adapted for dispensing currency, as shown in U.S. Pat. Nos. 3,836,980 and 3,897,901. Depository components of automatic banking equipment also have been of the rotary type as in said U.S. Pat. No. 3,897,901.

It is necessary at automatic unmanned banking equipment installations to provide the customer-depositor with a receipt for the deposit-containing envelope, and to identify the envelope and receipt with the same indicia. Prior depository constructions which issue receipts, either have severed a tag from special deposited-material containers, or have printed the deposit-identifying indicia on envelope and receipt simultaneously during conveyor travel.

Prior depository mechanisms using straight-through belt or chain conveyors have had conveyor means longitudinally split centrally laterally to accommodate printer means actuated during conveyor travel, or to accommodate deposite entry sensor triggers. Some of such conveyor mechanisms have required paddles mounted on the conveyors to push or retain in a pocket the deposit-containing envelope during movement along the conveyor.

Also, some of the prior conveyor-type depository mechanisms have had entry slots that are always open which renders the depository mechanism vulnerable to possible "fishing" attack.

Furthermore, the various types of prior depositories discussed above above all have had very complicated operating and security feature components and mechanisms, rendering the equipment expensive to manufacture and install, and difficult to maintain critical adjustments for, and to maintain in proper operating condition, while also maintaining secure protection of the deposited material at all times.

Finally, the requirement of providing special tags and tag-severing mechanism for containers for the deposits, and of maintaining availability of such special deposit containers, as distinguished from simple envelopes, at unmanned stations is not economically practical.

There thus exists a need in the field of bank depository services for a depository mechanism for unmanned stations which provides maximum security for the deposited material, which issues a receipt for the deposit after the material has been discharged to a chest, which utilizes only simple envelopes for containing the material to be deposited such as bank notes, checks and coin, which includes a belt conveyor having a simple design, construction and operation eliminating central longitudinal spacing or separation of conveyor components, and which provides effective gate valve means at the entry and exit ends of the conveyor for maintaining maximum security.

SUMMARY OF THE INVENTION

Objectives of the invention include providing new remote depository equipment actuated by a customer to open a positively-locked gate valve closing valve closing an entry slot for the depository mechanism; providing such construction equipped with a simple driven endless belt conveyor mechanism extending from the entry slot to an exit end and discharging into a security chest; providing such construction with printer means exteriorly of the conveyor having components located beyond the exit end of the conveyor to print indicia on a deposit-containing envelope being discharged from the conveyor simultaneously with the printing of similar indicia upon a receipt form issued to the customer after the envelope has been discharged to a security chest; providing the described components with a simple design, construction and minimum cost of manufacture, installation and maintenance; and providing a construction satisfying the stated objectives, which is difficult to damage by an intruder and which maintains maximum security at all times for the deposited material.

These and other objects and advantages may be obtained by the envelope depository construction which in general terms may be stated as including in an envelope depository construction of a type in which an envelope is inserted through an entry slot in a wall of a vault-like unit and is transported from the entry slot by conveyor means from conveyor entry to exit end and deposited in a safe-like chest; the combination of belt conveyor means having entry and exit ends; entry channel means at the conveyor entry end; exit channel means at the conveyor exit end; slidable entry and exit gate plate means located respectively at the entry and exit ends of the conveyor means; lever means for moving the entry and exit gate plate means between open and closed positions with the entry gate closed when the exit gate is open and vice versa; the entry channel means being located between the entry gate plate means and the unit entry slot and communicating between the entry slot and conveyor means entry end when the entry gate plate means is open; the exit channel means being located between the conveyor means exit end and the exit gate plate means and directing an envelope being deposited from the conveyor means to the chest when the exit gate plate means is open; the entry channel means including entry sensor means; the exit channel means including exit sensor means; drive means for the belt conveyor means; solenoid means for actuating the lever means; the solenoid means when energized moving the entry gate plate means from closed to open position and from open to closed position when deenergized; cam means operatively connected with the solenoid means for locking the entry gate plate means in closed position; means actuated by the cam means to signal the operative position of the gate plate means; printer means mounted on the conveyor means exteriorly of the exit gate plate means, operative to print identifying indicia on an envelope being discharged from the exit channel means; means actuated by the conveyor means when driven to signal the operative condition of the conveyor means; means actuated by the passage past the entry sensor means of the trailing end of an envelope being transported by the conveyor means to deenergize the solenoid means; means actuated by the passage past the exit sensor means of the leading end of such envelope to energize the printer means; means actuated by the passage past the exit sensor means of the trailing end of such envelope to deenergize the drive means; receipt printer means synchronized with the operation of the printer means to print said identifying indicia on a receipt; and the passage past the exit sensor means of the trailing end of the envelope also issuing the receipt to a depository customer.

BRIEF DESCRIPTION OF THE DRAWINGS

A preferred embodiment of the invention - illustrative of the best mode in which applicants have contemplated applying the principles — is set forth in the following description and is particularly and distinctly pointed out and set forth in the appended claims.

FIG. 1 is a fragmentary somewhat diagrammatic front elevation of automatic banking equipment equipped with the improved envelope depository construction;

FIG. 2 is a sectional view looking in the direction of the arrows 2—2, FIG. 1;

FIG. 3 is an enlarged fragmentary side view partly in section of the improved depository mechanism looking in the direction of the arrows 3—3, FIG. 1;

Similar numerals refer to similar parts throughout the various figures of the drawings.

DESCRIPTION OF THE PREFERRED EMBODIMENT

Figures 4, 7, 8, 9:
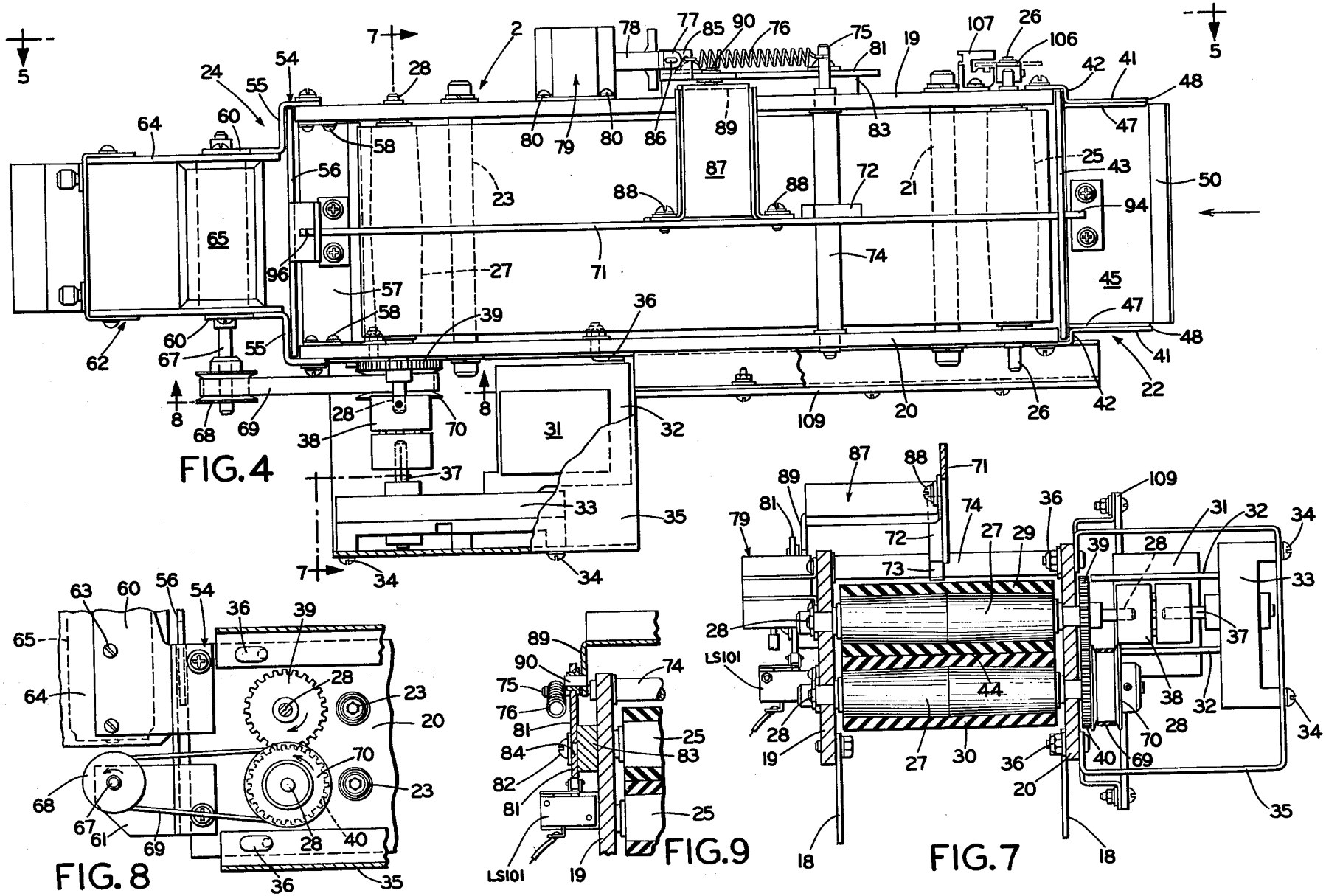
FIG. 4 is a plan view of the mechanism shown in FIG. 3, looking in the direction of the arrows 4—4, FIG. 3.
FIG. 7 is a sectional view looking in the direction of the arrows 7—7, FIG. 4.
FIG. 8 is a fragmentary sectional view taken on the line 8—8, FIG. 4.
FIG. 9 is a fragmentary sectional view taken on the line 9—9, FIG. 5.

A remote unmanned automatic banking unit equipped with the improved envelope depository mechanism is indicated generally at 1 in the drawings. The improved depository unit or mechanism is indicated generally at 2 and may be incorporated in the unit 1 to receive envelopes containing deposits entered through an entry slot 3 contained in the facia 4 of the banking unit 1.

As shown, the unit 1 may be a vault or safe-like structure 5 for security protection. The structure 5 has various compartments 6 and 7 therein closed by safe-like doors 8 and 9, having usual combination lock means **8*a* and 9*a*. A partition 10 extends between compartments 6 and 7 and has an access opening 11 communicating between the compartments 6 and 7. The compartment 7 may be termed a chest into which deposited material is discharged from the depository mechanism 2**.

Other compartments (not shown) may be formed in the vault structure 5 containing currency storage and dispensing means which may be actuated by a keyboard 12 and controlled by other devices, generally indicated at 13 in FIG. 1. The remote unit 1 may be of the general type of automatic currency dispenser shown in copending application Ser. No. 502,898, now U.S. Pat. No. 3,943,335, having a card entry slot 14 for the insertion preferably of a personalized conventional magnetic stripe plastic coded card for initiating an automatic banking transaction, as described in said application Ser. No. 502,898.

The devices generally indicated at 13 may include a panel display means for displaying instructions for carrying out a selected banking operation. A rotary drawer 15 also is provided for delivering cash, when a cash dispensing operation at bank unit 1 is carried out, and such rotary drawer may be of the type shown in U.S. Pat. No. 3,880,320. The unit 1 also may be equipped with a receipt slot 16 where a receipt for a transaction may be delivered to the customer at the completion of such banking transaction, whether it be one of depositing or one of cash dispensing.

The depository unit 2 which characterizes the concept of the invention is an improvement upon the remote depository of U.S. Pat. No. 3,836,980; and it retains desirable features of the prior construction but eliminates disadvantages which have been encountered with the prior construction.

Figures 5, 10:
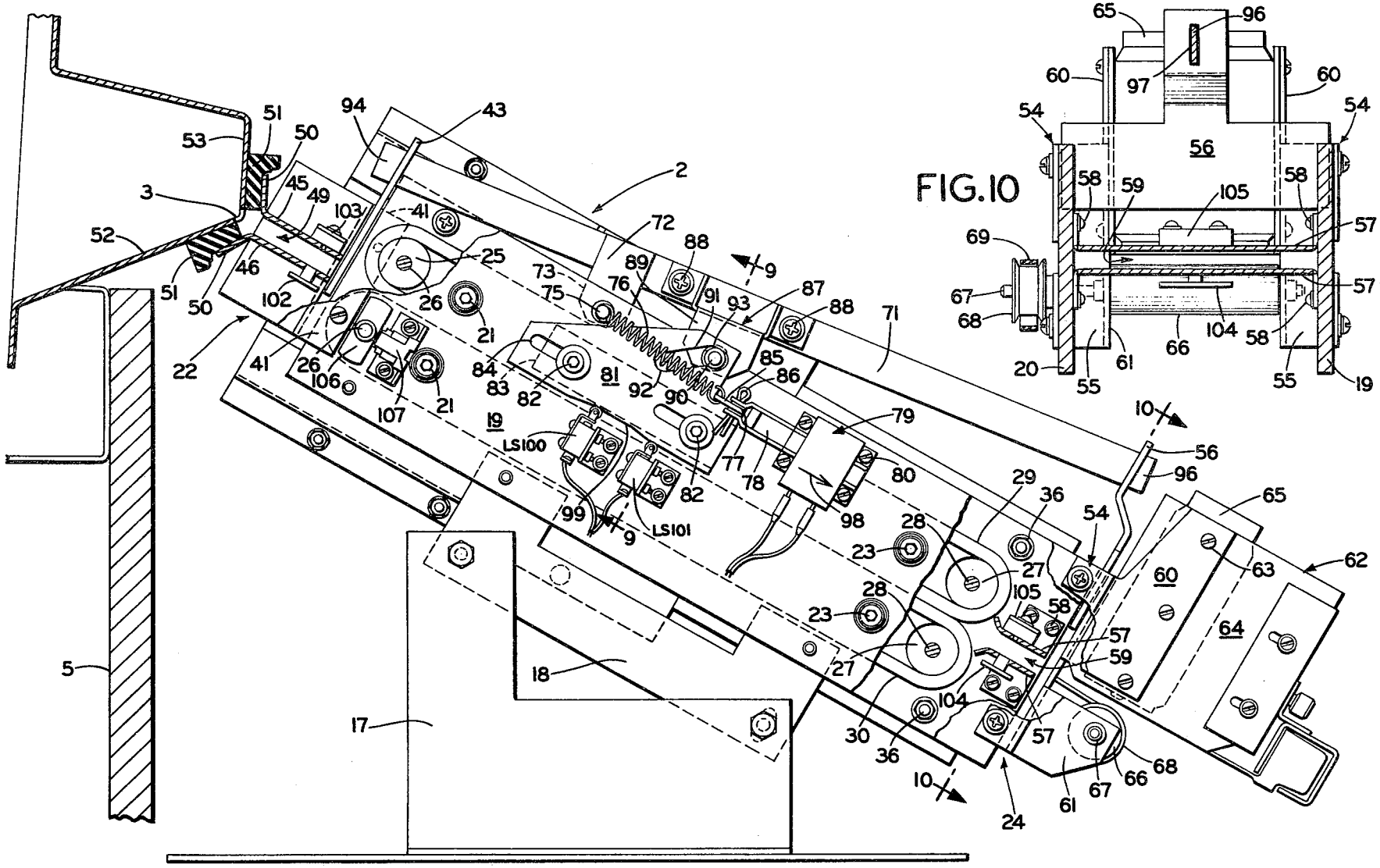
FIG. 5 is a back side elevation of the improved depository mechanism looking in the direction of the arrows 5—5, FIG. 4, the view being of the side of the mechanism opposite that shown in FIG. 3.
FIG. 10 is a sectional view looking in the direction of the arrows 10—10, FIG. 5.
Figures 6, 11:
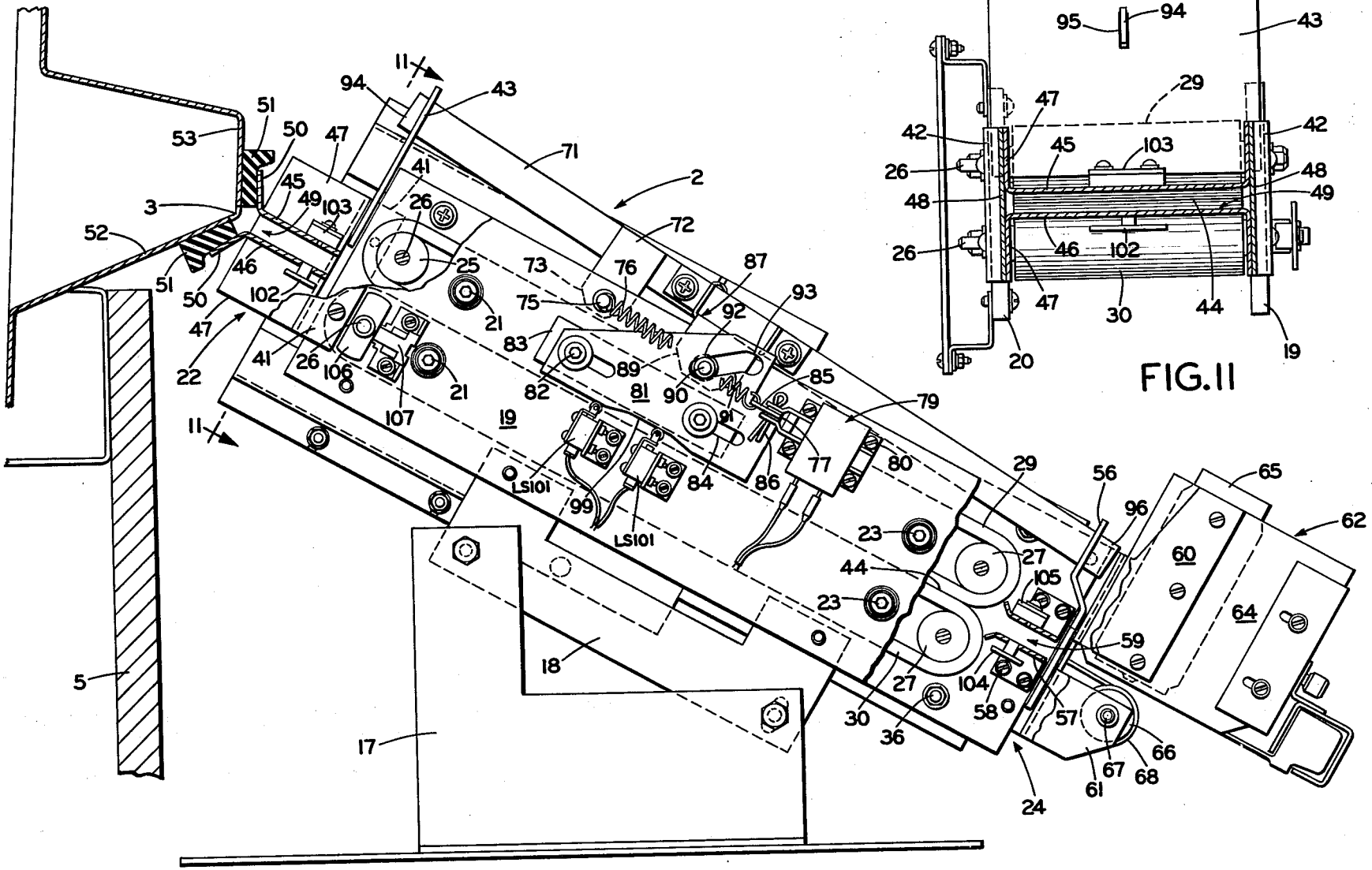
FIG. 6 is a view similar to FIG. 5 showing the various parts in another position with the entry gate open.
FIG. 11 is a sectional view of the entry end of the mechanism looking in the direction of the arrows 11—11, FIG. 6; a position with an envelope about to be entered into the mechanism.

Brackets 17 are mounted to extend upward from partition wall 10 to support mounting plates 18 (FIGS. 5, 6 and 7). Side plates 19 and 20 for the conveyor mechanism are mounted on plates 18. A pair of tie rods 21 at the entry 22 and another pair of tie rods 23 at the exit end 24 of the depository unit 2 tie the side plates 19 and 20 togeter and maintain them in proper spaced relation.

A pair of spaced conveyor entry rollers 25 mounted on shafts 26 journaled in side plates 19 and 20 are located at the unit entry end 22 and a similar pair of spaced conveyor exit rollers 27 mounted on shafts 28 journaled in side plates 19 and 20, are located adjacent the exit end 24 of the unit 2. An upper flexible conveyor or transport belt 29 and a lower transport belt 30 are trained over the rollers 25 and 27.

The belts 29 and 30 preferably are formed of a soft rubber composition which will yield sufficiently to conform to the thickness of an envelope being transported through the mechanism by the belt conveyor between the belts 29 and 30.

Rollers 25 and 27 and belts 29 and 30 are driven by a motor 31 mounted on a bracket 32 extending from a gear box 33 carried at 34 by a C-shaped housing enclosure 35 (FIG. 7) that is bolted at 36 to the exterior of the side plate 20 adjacent the exit end 24 of the unit 2. The motor 31 drives gears (not shown) contained in the gear box 33, which in turn drive a shaft 37 extending from the gear box 33 to a coupling 38 connected to one end of the upper conveyor roller shaft 28 at the unit exit end 24. An upper gear 39 mounted on upper roller shaft 28 meshes with lower gear 40 on the end of lower roller shaft 28 (FIG. 8) so that the belts 29 and 30 are driven in synchronism.

A pair of Z-shaped brackets 41 is mounted on the entry ends of the side plates 19 and 20 with their shoulder portions 42 spaced from the ends of side plates 19 and 20 to provide channels in which an entry plate member 43 is slidably mounted for movement in a plane perpendicular to the bite 44 between the transport belts 29 and 30 (FIGS. 6 and 11).

Upper and lower U-shaped channel brackets 45 and 46 have their legs 47 fixed to the inner flanges 48 of the Z-shaped brackets 41. The webs of channel brackets 45 and 46 are spaced apart to form an entry channel 49 aligned with the bite 44 between transport belts 29 and 30 (FIGS. 5, 6 and 11). The outer ends of the webs of brackets 45 and 46 are flared at 50 to provide a throat opening for entry channel 49, and flared ends 50 engage gaskets 51 against the recessed walls 52 and 53 of the facia 4. The entry slot 3 is formed in the facia wall at the corner between the facia walls 52 and 53 (FIGS. 5 and 6) aligned with the entry channel 49 and the bite 44 between the transport belts 29 and 30.

Another pair of Z-shaped brackets 54 is mounted on the exit ends of the side plates 19 and 20 with their shoulder portions 55 spaced from the exit ends of the side plates 19 and 20 to provide channels in which an exit gate plate member 56 is slidably mounted for movement in a plane perpendicular to the bite 44 between the transport belts 29 and 30 at the unit exit end 24 (FIGS. 4 and 10).

A pair of channel brackets 57 is mounted by screws 58 in spaced relation extending between the exit ends of the side plates 19 and 20 (FIGS. 5 and 10). The spacing between the brackets 57 forms an exit channel 59 aligned with the bite 44 between the transport belts 29 and 30 at the exit end of the conveyor.

The exit ends of Z-shaped brackets 54 have bifurcated flange portions comprising upper support flanges 60 and lower roll support flanges 61 (FIGS. 4, 5, 10 and 17). A printer assembly 62 is mounted by screws 63 on and between the upper support flanges 60 of the Z-brackets 54.

The printer assembly 62 thus is mounted beyond the exit end 24 of the conveyor and printer 62 includes a housing 64 and a printer head 65 of usual construction, the operation of which is described below.

Figure 17:
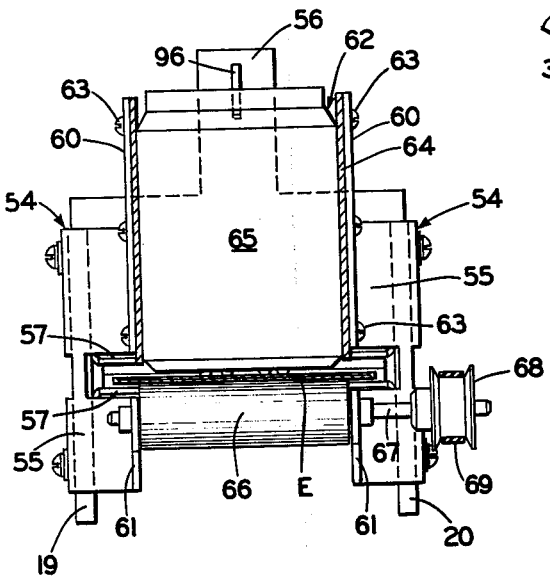
FIG. 17 is an enlarged sectional view looking in the direction of the arrows 17—17, FIG. 15.
Figure 16:
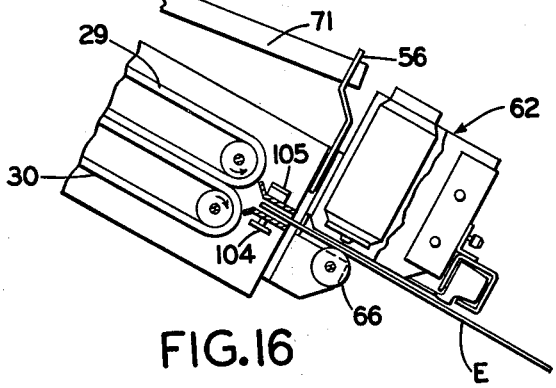
FIG. 16 is a view similar to FIGS. 14 and 15 showing the envelope trailing end just leaving the exit end of the conveyor.

A printer platen roll 66 is journaled on roll support flanges 61 of Z-brackets 54 between the flanges 61 and below the printer head 64 (FIGS. 8 and 17). One end of the shaft 67 of roll 66 projects to a zone adjacent the drive motor housing 35 (FIG. 4), and a pulley 68 is mounted on shaft end 67 driven by a belt 69 trained around a drive pulley 70 mounted on the lower exit roller shaft 28 (FIG. 7).

A gate valve operating lever 71 has a crank arm 72 fixed thereto intermediate the ends of lever 71, and the projecting end 73 of arm 72 is fixed to a shaft 74 (FIGS. 4 and 5) which is journaled on and extends between side plates 19 and 20. One end 75 of shaft 74 projects outside of side plate 19 and is engaged by a spring 76, the other end of which is connected at 77 to the armature 78 of the solenoid 79, mounted on the outside of side plate 19 by screws 80.

A cam plate 81 is mounted on pins 82 for limited longitudinal movement in a direction parallel with the line of travel of the conveyor belts. The pins 82 extend from a spacer block 83 located on the outside of side plate 19 adjacent the solenoid 79. The pins 82 extend through elongated slots 84 in the cam plate 81 to permit the described movement.

An ear 85 extends outwardly from one end of cam plate 81 forming part of the connection 77 of spring 76 with the solenoid armature 78, the ear 85 and armature 78 being joined by cotter pin 86. A channel member arm 87 is mounted on lever 71 by screws 88 (FIGS. 4, 5 and 6) projecting laterally to a zone adjacent the cam plate 81 and solenoid 79. The outer end of arm 87 has a downturned flange 89 provided with a cam pin 90 which projects into a cam slot 91 in cam plate 81.

The cam slot 91 is angular in shape, as best shown in FIGS. 5 and 6, and has an elongated actuating portion 92 extending at an angle to the line of travel of the belts 29–30. At the top end of the angular cam slot portion 92, a locking slot portion 93 is provided which extends in a direction parallel with the line of travel of the belt conveyor 29–30. The cam pin 90 is in a locked position when located in cam slot locking portion 93 shown in FIG. 5 and is unlocked when in the angular actuating position 92 as shown in FIG. 6, for reasons to be described.

The entry end 94 of gate lever 71 extends through a slot 95 in entry gate plate 43 (FIGS. 6 and 11), and the exit end 96 of lever 71 extends through a slot 97 in the exit gate plate 56.

The construction and coordinated relationship between the lever 71 and gate plates 43 and 56, and the sliding movements of the plates 43 and 56 in the described channels between the ends of the side plates 19 and 20 and the Z-brackets 41 and 54, provide for seesaw movement of lever 71 about the pivot axis of shaft 74 to lower the exit gate plate 56 (FIG. 6) when the entry gate plate 43 is raised, and to lower the entry gate plate 43 (FIG. 5) when the exit gate plate 56 is raised.

When the entry plate 43 is in the lowered position, communication between the entry channel 49 and the belt conveyor 29–30 is cut off, as shown in FIG. 5; and when the exit gate plate 56 is lowered, communication between the exit channel 59 and the exterior of the conveyor mechanism is cut off, as shown in FIG. 6.

Thus, irrespective of the position of the gate plate lever 71, at no time is there direct communication from the exterior of the unit 2 through the facia slot 3 and the conveyor mechanism, to the interior of the protective compartments 6 and 7 of the bank unit 1.

Furthermore, when the gate plate 43 is in down or closed position of FIG. 5, cam pin 90 is in the locking portion 93 of cam slot 91 which effectively locks the lever 71 and gate plate 43 in the down, closed or cut-off position. The construction of a sliding gate plate locked, per se, in a locked or closed position provides maximum security against attempts of an intruder to dislodge such gate plate and gain access to the interior of the unit 1. This cooperative arrangement avoids difficulties that can be experienced from a security standpoint with the rocking bar construction of the depository in U.S. Pat. No. 3,836,980, wherein the slotted closure flange at the end of the rocking bar for closing the deposit entry slot can be readily pried open.

The operation of the lever 71 is controlled by the solenoid 79 and the spring 76. Assume that the parts are in the normal position of FIG. 5 with the entry gate plate 43 closed. At such time that the solenoid 79 is energized, its armature 78 moves in the direction of the arrow 98 (FIG. 5) which pulls cam plate 81 to the right from the position of FIG. 5 to the position of FIG. 6. During this cam plate movement, cam slot 91-92-93 engaging cam pin 90 moves the cam pin downward which imparts forces that pivot the lever 71 about shaft 74 from the position of FIG. 5 to that of FIG. 6, thus raising entry gate plate 43 and lowering exit gate plate 56.

When the solenoid 79 is deenergized, spring 76 pulls solenoid armature 78 back to the position of FIG. 5 moving cam plate 81 to the left from the position of FIG. 6 to that of FIG. 5. During such movement, cam pin 90 rides along cam slot 91 to the locked position of cam pin 90 in locking portion 93 of cam slot 91, thus moving lever 71 back to the position of FIG. 5 from that of FIG. 6, closing entry gate 43 and opening exit gate 56.

The cam plate 81 (FIGS. 5 and 6) has a cam contour 99 at its bottom edge, engaged by a pair of limit switches, LS-100 and LS-101. These limit switches, LS-100 and LS-101, are used to signal the control circuitry for the operation of the depository unit 2 as to the status or position of the cam plate 81 and therefore of the lever 71 and the gate plates 43 and 56. Thus, assuming that LS-100 is open and LS-101 is closed in FIG. 5, the cam plate 81 in a position locking lever 71 and the entry gate plate 43 is closed. The reverse status is shown in FIG. 6 where limit switch LS-100 is closed and limit switch LS-101 is open, which signals that the cam plate 81 has been released from locking position and that lever 71 has opened entry gate plate 43.

The entry channel 49 is provided with a pair of entry photocell or sensor components 102 and 103, which project a light beam across the channel 49 to detect the status of a deposit envelope passing through the entry channel 49. Similarly, the exit channel 59 is equipped with a pair of exit photocell components 104 and 105 to signal the status of a deposit envelope passing through the exit channel 59.

Preferably, the lower entry roller shaft 26 (FIGS. 4, 5 and 6) is equipped with an inductance switch comprising a blade 106 on the shaft 26 and a field 107 which initiates signals on rotation of shaft 26 to indicate that the conveyor belts 29-30 are moving.

The depository unit 2 is provided (FIG. 2) with a receipt printer 108 which may be mounted at a convenient location within compartment 6 to print a receipt containing the same information as printed by the printer 62. The operation of the printer 62 is coordinated or synchronized with that of the receipt printer 108 and printer 108 will not deliver a printed receipt through the receipt slot 16 until a depository cycle has been completed, as described below. The receipt printer 108 and envelope printer 62 may be of known types and may be operated in the manner described in U.S. Pat. No. 3,836,980.

The printer head 65 of envelope printer 62, when energized, moves up and down against the platen roll 66 to imprint an envelope passing between the printer head 65 and roll 66 with any desired identifying indicia such as a transaction number, the date and time. The same information is printed by the receipt printer 108 on the receipt which is issued.

Preferably, a typical electrical or electronic, preferably printed, circuit board 109 containing control circuitry may be mounted on the outside of side plate 20 of the conveyor mechanism. The control circuitry in which the solenoid, the sensors, the printer actuators, the conveyor drive motor, etc. are connected also preferably includes a control computer for the cycled depository operation.

Manifestly, the operation of the various components are coordinated and programmed using typical circuitry and electrical or electronic control devices automatically to operate the equipment in the manner described upon activation of the equipment.

OPERATION OF THE DEPOSITORY

Typical operation of the envelope depositing cycle carried out in the use of the new depository unit 2 incorporating the concepts of the invention is illustrated diagrammatically in FIGS. 12 through 16. If the depository 2 is a part of a remote banking unit 1, as illustrated, which also has cash dispensing equipment, then the use of the equipment generally may have been initiated by a customer using whatever means is provided to energize the unit 1. This may include entry of an identification number in the keyboard 12, following which one of the buttons of the keyboard may be pressed to energize the depository unit 2.

However, if the depository 2 constitutes a remote deposit station by itself, it can be energized directly merely by pressing a button controlling or energizing the circuitry and supplying power to the components. Such a button may, if desired, be protected by a lock and key or may be part of a key switch which is unlocked by a key in the authorized possession of a customer.

If the depository 2 is a part of a remote automatic banking unit 1, which is actuated by a customer card having magnetic stripes inserted into the card entry slot indicated at 14, the automatic operation of such a unit 1, as described in said application Ser. No. 502,898, at a proper time in the cycle of operation will present a message at the display panel 13 directing the depositor to depress a certain button to indicate the desire to make a deposit. When the customer presses the indicated button, the depository unit 2 will be energized.

Figure 12:
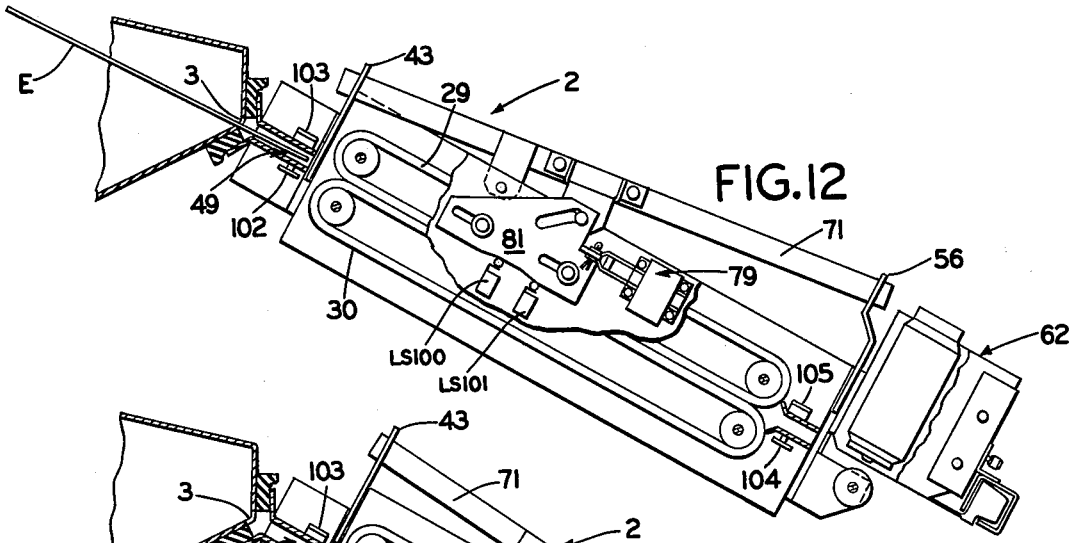
Figure 13:
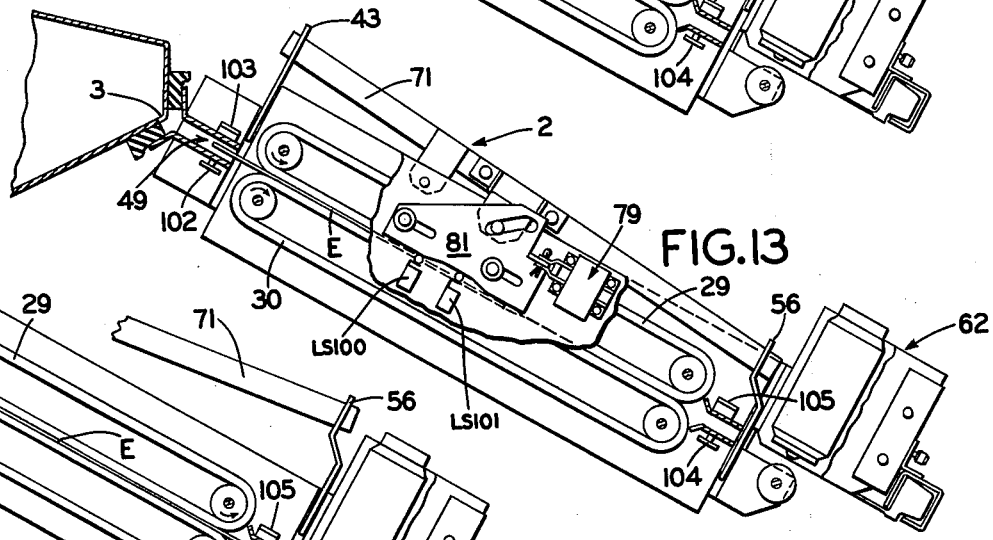
FIG. 13 is a view similar to FIG. 12 showing the envelope inserted and being conveyed through the entry gate into the mechanism.

Regardless of the manner in which the unit 2 is energized, when energized, the solenoid 79 is energized and pulls the cam plate 81 from the position of FIG. 12 to the position of FIG. 13 opening entry gate plate 43 to allow an envelope E to be entered into the conveyor mechanism through entry channel 49. At the same time that the entry gate plate 43 is opened, the exit gate plate 56 is closed. At the same time, the limit switches, LS-100 and LS-101, signal the computer that the entry gate is open. At the same time, motor 31 is energized to drive the conveyor belts 29 and 30.

Preferably, if no envelope E is entered through the entry channel 49 and past the entry photocell sensors 102 and 103 within a predetermined time thereafter of a few seconds, the motor 31 is stopped, the solenoid 79 is deenergized, and the spring 76 through lever 71 closes entry gate plate 43.

Figure 14:
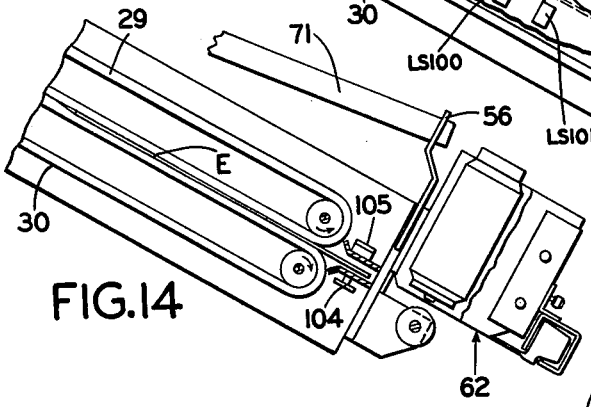
FIG. 14 is a view similar to a part of FIG. 13 showing the envelope leading end approaching the exit gate.

However, if a deposit envelope E is inserted by a customer into the entry channel 49, it is engaged by the belt conveyor 29-30 and passes along the conveyor, as indicated in FIG. 13. As the trailing end of the envelope E passes entry sensor 102-103 after, say three to six seconds delay to assure clear passage of a crooked or diagonally-entered envelope, a signal is given to the control circuitry and the solenoid 79 is deenergized and spring 76 returns the entry gate plate 43 to closed and locked position and the exit gate 56 is opened, as shown in FIG. 14.

Figure 15:
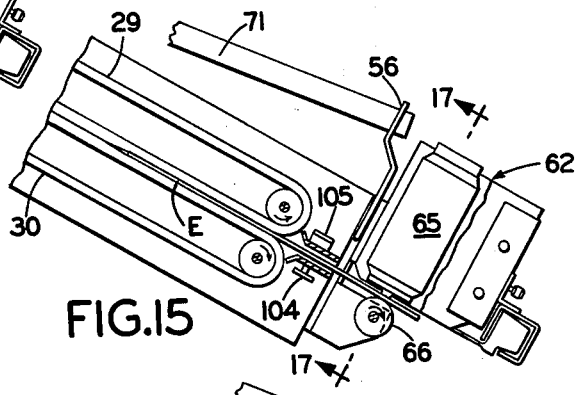
FIG. 15 is a view similar to FIG. 14 showing the envelope passing through the exit gate.

At this time, the switches, LS-100 and LS-101, are actuated by the return of the cam plate 81 to the position of FIG. 5 and a signal is given to the computer that the entry gate plate 43 has been closed and locked. The envelope E continues to be conveyed until the leading end of the envelope E passes under the exit photocell sensors 104 and 105 (FIG. 14) which signal the printer assembly 62 and energizes the same for operation so that as the envelope E continues to travel, as shown in FIG. 15, the printer head 65 depresses several times at intervals to print indicia on the envelope.

When the trailing end of the envelope passes the exit sensors 104 and 105 (FIG. 16) the sensors 104 and 105 signal such condition, and through the control circuitry the motor 31 is stopped, and a signal is sent to the computer to issue to the customer the receipt from receipt printer 108, which had been printed at the same time that printer head 65 was actuated. Meanwhile, envelope E drops through the opening 11 into the security deposit chest 7.

The unit 2 thus has completed a cycle of operation and is ready for another similar cycle of operation, the entry gate plate 43 being closed and locked, awaiting actuation of the activating means by a customer who desires to carry out another deposit operation.

The important facets of the concept of the improved straight-through travel envelope depository include retaining all desirable features of U.S. Pat. No. 3,836,980 while avoiding difficulties encountered with the prior construction; include the provision of a belt conveyor structure having an entry gate and entry sensors 102-103 which are located and coordinated in operation to prevent closing of the entry gate plate 43 at any time while the envelope E or a portion thereof is located beneath the gate plate 43; include a cooperative arrangement of the depository components in which the passage of the leading end of an envelope E beneath the exit sensors 104-105 activates operation of the printer 62; include a construction in which a printer is divorced from a location within the confines of the conveyor mechanism and thus avoids complicated conveying mechanism which must be split longitudinally to accommodate the printer; include a construction in which the trailing end of the envelope E which has been transported through and conveyor mechanism is sensed by the entry sensor 102-103 to activate the control system to deenergize the solenoid 79, thereby closing the entry gate plate 43; include switch means actuated by the cam plate to indicate the fully open or fully closed position of the entry gate; and include a construction wherein sliding gate plates are used for the entry and exit ends of a simplified belt conveyor system to provide for maximum security.

In describing the operation of the equipment and in summarizing important facets of the concept, the trailing end of the envelope E has been stated as being sensed by the entry sensors 102-103 to close the entry gate plate 43 and open the exit gate plate 56. Alternatively, control of the positions of the entry and exit gate plates 43 and 56 to open the exit gate plate 56 may be exercised by the exit sensors 104-105 so that when the leading edge of an envelope E arrives at the exit sensors 104-105, these sensors activate the control system to deenergize the solenoid 79 to thereby close the entry gate plate 43 and open the exit gate plate 56.

The reason for this alternatively described control of the entry and exit gate plate positions is to prevent the equipment from being fooled or improperly operated by an individual accidentally or intentionally causing a malfunction by inserting in and immediately removing the front end of an envelope from the entry channel 49 and sensor 102-103. Sensors cannot distinguish a leadng from a trailing envelope end but signaling from sensors depends on blocking or unblocking a light beam.

Regardless of the manner in which the ends of an envelope actuate sensors to activate the control system to change the gate plate positions, the equipment functions otherwise in the same manner.

Accordingly, the foregoing new features of the present invention provide a new remote envelope depository construction and mode of operation which achieve the stated objectives, eliminate difficulties arising from prior devices, and solve problems and obtain the described new results.

In the foregoing description, certain terms have been used for brevity, clearness and understanding, but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the equipment is constructed and operated, and the advantageous, new and useful results obtained; the new and useful structures, devices, elements, arrangements, parts, combinations, systems, equipment, operations and relationships are set forth in the appended claims.

We claim:

1. In envelope depository construction of a type in which a conveyor transports a deposit envelope from an entry slot in a depository unit and delivers it to a safe-like chest in said unit, and in which printer means prints identifying indicia on the envelope before delivery to the chest; the combination of double, endless, laterally continuous, opposed belt conveyor means having entry and exit ends for transferring an envelope trapped in the bite between said opposed belts from conveyor entry to exit ends; drive means for the conveyor means; entry channel means located adjacent the conveyor entry end; exit channel means located adjacent the conveyor exit end; gate plate means including a plate member located adjacent each of the conveyor entry and exit ends; means slidably mounting the gate plate members for movement between closed and open positions; means for moving the gate plate members between closed and open positions including a lever pivotally mounted intermediate its ends, one of the lever ends engaging the entry gate plate member and the other lever end engaging the exit gate plate member whereby the exit plate may be moved to open position when the entry plate is moved to closed position and vice versa, spring means engaging the lever normally biasing the lever to hold the entry gate plate member in closed position, solenoid means having an armature connected with the biasing spring means, the solenoid means when energized actuating the lever to move the entry gate plate member from closed to open position and when deenergized permitting the biasing spring means to actuate the lever to move the entry gate plate member from open to closed position, a slidably mounted movable cam plate operatively connected with the solenoid armature and the biasing spring means, the cam plate having slot and pin connection with the lever, and the cam slot having a lock portion engaging the pin to lock the entry gate plate member in locked position when the lever is biased to normally closed position by the spring means; and means for energizing the conveyor drive means and the plate moving means to move the entry gate plate member to open position for accepting a deposited envelope.

2. The construction defined in claim 1 in which the cam plate has a contoured edge and in which switch means engages the contoured edge to signal the operative position of the gate plate means.

3. In envelope depository construction of a type in which a conveyor transports a deposit envelope from an entry slot in a depository unit and delivers it to a safe-like chest in said unit, and in which printer means prints identifying indicia on the envelope before delivery of the chest; the combination of double, endless, laterally continuous, opposed belt conveyor means having entry and exit ends for transferring an envelope trapped in the bite between said opposed belts from conveyor entry to exit ends; drive means for the conveyor means; entry channel means located adjacent the conveyor entry end; exit channel means located adjacent the conveyor exit end; gate plate means including a plate member located adjacent end of the conveyor entry and exit ends; means slidably mounted the gate plate members for movement between closed and open positions; means for moving the gate plate members between positions, and for locking the entry gate plate in closed position; the means for moving the gate plate members between closed and open positions including a lever, solenoid means, spring means and cam means; the conveyor means including side plate means, the lever being pivotally mounted on the side plate means and having pin and slot connected with the cam means, and the lever pin connection being spaced from the lever pivot mounting on the side plate means; the cam means being slidably mounted on the side plate means, the spring means and cam means being operatively connected with the solenoid means, and the lever being operatively connected at its ends respectively with the entry and exit gate plate members; the pivot mounting of the lever on the side plate means including a pivot shaft fixed intermediate its ends to the lever, and the pivot shaft being pivotally mounted adjacent its ends in the side plate means; the pin and slot connection of the lever with the cam means being spaced from said pivot shaft, and the slot having an angular portion and a locking portion; the pin traveling along the angular slot portion to pivot he lever about said pivot shaft when the cam means is moved slidably on its mounting on the side plate means, and the solenoid means when energized slidably moving the cam means to move the pin along the angular slot portion thereby moving the entry gate plate from closed to open position; and means for energizing the conveyor drive means and the plate moving means to move the entry gate plate member to open position for accepting a deposited envelope.

4. In envelope depository construction of the type in which a conveyor transports a deposit envelope from an entry slot in a depository unit and delivers it to a safe-like chest in said unit, and in which printer means prints identifying indicia on the envelope before delivery to the chest; the combination of walls forming a chamber in the unit in one of which walls said entry slot is formed; double, endless, laterally continuous, opposed belt conveyor means having entry and exit ends for transferring an envelope trapped in the bite between said opposed belts from conveyor entry to exit ends; means for mounting said conveyor means in said chamber; drive means for the conveyor means; entry channel means located in said chamber extending from said entry slot to a zone adjacent the conveyor entry end; exit channel means located in said chamber adjacent the conveyor exit end extending to a zone spaced from said exit end; gate plate means including a first entry gate plate member located between the entry channel means and the conveyor entry end and a second exit gate plate member located adjacent the exit channel means at the zone spaced from the conveyor means exit end; means carried by said conveyor mounting means slidably mounting the gate plate members for rectilinear movement between closed and open positions with the exit gate plate in open position when the entering gate plate is closed and vice versa; means for rectilinearly moving the gate plate members between such positions, and for locking the entry gate plate in closed position; and means for energizing the conveyor drive means and the plate moving means to move the entry gate plate member for normally closed position to open position for accepting a deposited envelope.

5. The construction defined in claim 4 in which the entry channel means includes entry sensor means located adjacent the first entry gate plate member, and in which actuating means are activated by the entry sensor means to energize the gate plate member moving means to move the first entry gate plate member after being in open position to closed position upon the passage past the entry sensor means of the trailing end of an envelope inserted, while the entry gate plate member is in open position, into the entry channel means and which inserted envelope is being transported by the conveyor means toward the conveyor exit end.

6. The construction defined in claim 4 in which the exit channel means includes exit sensor means located adjacent the second exit gate plate member; in which printer means are mounted on the conveyor means beyond the exit gate plate member; and in which actuating means are activated by the exit sensor means to energize the printer means upon the passage past the exit sensor means of the leading end of an envelope being transported by the conveyor means toward the exit gate plate member.

* * * * *

UNITED STATES PATENT AND TRADEMARK OFFICE

CERTIFICATE OF CORRECTION

PATENT NO. : 4,085,687

DATED : April 25, 1978

INVENTOR(S) : Robert Beck, Herbert J. Morello, Jack M. Richardson

It is certified that error appears in the above-identified patent and that said Letters Patent are hereby corrected as shown below:

In introduction, line (75) Inventors: "Robert Beck; Herbert J. Morello," should be -Robert J. Beck; Herbert Morello- Col. 1, line 55 -- "deposite" should be -deposit- Col. 1, line 65 -- "above above" should be -above- Col. 2, line 26 -- "valve closing should be deleted.

Col. 3, line 64 and 65 -- "a position with an envelope about to be entered into the mechanism;" should be omitted at this point (it is part of (Fig. 12 which was omitted.)

UNITED STATES PATENT AND TRADEMARK OFFICE

CERTIFICATE OF CORRECTION

PATENT NO. : 4,085,687

DATED : April 25, 1978

INVENTOR(S) : Robert Beck, Herbert J. Morello, Jack M. Richardson

It is certified that error appears in the above-identified patent and that said Letters Patent are hereby corrected as shown below:

It should read:
-Fig. 12 is a fragmentary view illustrating the parts in a position with an envelope about to be entered into the mechanism;-

Col. 4, line 64 -- add -end- after "entry"

Col. 4, line 66 -- "togeter" should be -together-

Col. 6, line 3 -- "64" should be -65-

Col. 6, line 34 -- "best" should be -being-

Col. 6, line 58 -- add -gate- after "entry"

Col. 9, line 64 -- "and" should be -the-

Col. 10, line 23 -- "leadng" should be -leading-

UNITED STATES PATENT AND TRADEMARK OFFICE

CERTIFICATE OF CORRECTION

PATENT NO. : 4,085,687

DATED : April 25, 1978

INVENTOR(S) : Robert Beck, Herbert J. Morello, Jack M. Richardson

It is certified that error appears in the above-identified patent and that said Letters Patent are hereby corrected as shown below:

CLAIMS

Col. 11, line 37 -- "of the" should be -to the-

Col. 11, line 45 -- add -each- after "adjacent"

Col. 11, line 46 -- "mounted" should be -mounting-

Col. 11, line 62 -- "pivot" should be -pivotal-

Col. 12, line 3 -- "he" should be -the-

Col. 12, line 43 -- "for" should be -from-

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*